United States Patent [19]

Esposito et al.

[11] 3,988,084

[45] Oct. 26, 1976

[54] ATOMIZING NOZZLE ASSEMBLY FOR MAKING METAL POWDER AND METHOD OF OPERATING THE SAME

[75] Inventors: David Esposito, Reading; Raymond A. Reiter, Kehnorst; Gregory J. Del Corso, West Lawn, all of Pa.

[73] Assignee: Carpenter Technology Corporation, Reading, Pa.

[22] Filed: Nov. 11, 1974

[21] Appl. No.: 522,713

[52] U.S. Cl. ..... 425/7; 222/594; 264/12; 239/424

[51] Int. Cl.[2] ..... B22D 23/08

[58] Field of Search ..... 239/82, 85, 290, 8, 239/424; 425/7; 264/12; 222/DIG. 11–14

[56] References Cited

UNITED STATES PATENTS

| | | | |
|---|---|---|---|
| 2,678,480 | 5/1954 | Lapin | 222/DIG. 13 |
| 3,062,451 | 11/1962 | Keohane, Jr. | 239/82 X |
| 3,253,783 | 5/1966 | Probst et al. | 239/82 |
| 3,533,136 | 10/1970 | Holtz, Jr. | 425/7 |
| 3,554,520 | 1/1971 | Grosko | 222/DIG. 13 |
| 3,556,780 | 1/1971 | Holtz, Jr. | 264/12 X |
| 3,588,951 | 6/1971 | Hegmann | 264/12 |

FOREIGN PATENTS OR APPLICATIONS

| | | | |
|---|---|---|---|
| 471,599 | 2/1951 | Canada | 239/82 |

*Primary Examiner*—John J. Love
*Assistant Examiner*—Michael Mar
*Attorney, Agent, or Firm*—Edgar N. Jay

[57] ABSTRACT

A nozzle assembly for atomizing a stream of molten metal includes a refractory metal-transmitting nozzle having a short metering orifice at its entrance end and a relatively long divergent discharge passage terminating at a flat annular land formed at the bottom end of the metal-transmitting nozzle. The metal-transmitting nozzle is seated in an opening in the bottom of a tundish or other source of molten metal with its upper end containing its metering orifice projecting into the molten metal reservoir. The lower-end portion projects from the bottom of the tundish and through the central portion of an atomizing fluid nozzle assembly in which it seats. The central portion of the atomizing fluid nozzle assembly projects below the bottom member of the atomizing fluid nozzle assembly and forms an atomizing fluid orifice therewith.

The process of utilizing the apparatus for atomizing powder is described in which a molten metal film is formed around the outer bottom portion of the metal-transmitting nozzle which extends below the central portion and orifice of the atomizing fluid nozzle assembly.

6 Claims, 2 Drawing Figures

ATOMIZING NOZZLE ASSEMBLY FOR MAKING METAL POWDER AND METHOD OF OPERATING THE SAME

BACKGROUND OF THE INVENTION

This invention relates to a method and apparatus for atomizing a stream of molten metal into small particles in the preparation of metal powder and, more particularly, to such a method and apparatus in which an atomizing fluid impinges molten metal falling from a nozzle so as to form particulates therefrom.

It is broadly old to pass a stream of molten metal through a nozzle and to direct one or more high velocity fluid jets at the emerging stream to break up the sream into small globules which solidify into particulates of varying sizes.

However, nozzle arrangements for atomizing metal for use in making powdered products have left much to be desired. Some structures have proven to be undesirably sensitive to clogging because of the build up of solidified metal in the discharge passages or orifices. Another drawback of nozzle structures hitherto in use results from the contamination of the powder metal product by nonmetallics usually in the form of refractory particles abraded from refractory nozzles hitherto in use. Yet another common defect of such nozzles has been the production of too large a proportion of particles of sizes which require scrapping in order to avoid impairment of the density and uniformity of the product below an acceptable level.

The atomizing nozzle structure of U.S. Pat. No. 3,253,783 is illustrative of a structure susceptible to clogging and also abrasion of the refractory so as to contaminate the powder metal product. In that patent, the molten metal passageway 18 is relatively long and of small diameter so as to form an extended restriction in the path of the molten which has an undesirable tendency to clog in use. The atomizing gas nozzle is fitted to the pouring cup or tundish so that at least a portion of the gas stream impinges directly against the annular edge of the ceramic stem 16 through which the molten metal flows from the pouring cup, and this causes abrasion of the structure and contamination of the product.

SUMMARY OF THE INVENTION

Therefore, a principal object of this invention is to provide an improved nozzle assembly and method for atomizing a stream of molten metal to form powder metal which has enhanced efficiency in operation.

Another object is to provide such a nozzle assembly and method which is characterized by the production of particles having sizes which better favor the formation of powder metal compacts having improved density and unformity.

A further object of this invention is to provide such a nozzle assembly and method of operating the same in which the emerging stream of molten metal is caused to spread substantially uniformly radially outward across a bottom annular face of the nozzle whereby to form a thin radially outward flowing sheet of molten metal which is atomized or broken up to form particulates having improved size distribution, and in which part of the molten metal is caused to flow back over and coat the outer surface of the molten metal nozzle which is impinged by the atomizing fluid jet.

A more specific object is to provide such a nozzle assembly having a molten metal metering restriction so located in relation to the molten metal reservoir that the only heat required is that available from the molten metal.

In carrying out the present invention, there is provided a nozzle assembly which is operatively associated with a tundish or other suitable means for providing molten metal to be atomized, and which has a metal-transmitting nozzle, preferably formed of ceramic material provided with a short cylindrical entrance bore which serves as a metering orifice to restrict the flow of metal and which in turn leads into a relatively long passage having divergent walls terminating at the lower end of the metal-transmitting nozzle preferably in a flat annular surface disposed in a plane normal to the longitudinal axis of the nozzle. The diameter of the exit end of the nozzle passage is much larger than that of the metering orifice so that the possibility of clogging is minimized even when the tundish or other pouring device is not heated except by the molten metal.

The means for providing molten metal is seated on the upper surface of an atomizing fluid nozzle assembly with its metal-transmitting nozzle seated in a central bore formed for that purpose in the atomizing fluid nozzle assembly. The atomizing fluid nozzle assembly has upper and lower mating members which together form an annular atomizing fluid plenum communicating with the bottom-end portion of the metal-transmitting nozzle through a concentric annular orifice.

It is an important feature of this invention that means are provided for forming a film of molten metal around the outer surface of the bottom-end portion of the metal-transmitting nozzle. In the preferred apparatus for carrying out the present invention in which the atomizing fluid annular orifice is formed by an annular gap between the upper and lower members of the atomizing fluid nozzle assembly, the gap-forming portion of the upper member forms the bore in which the metal-transmitting nozzle is seated, engirdling the same with both extending below the orifice-forming portion of the lower member. The dimensions of the parts and the inclination of the annular gap are such that the lower portion of the metal-transmitting nozzle which is impinged only by the peripheral portion of the atomizing fluid is coated with molten metal. This works to substantially reduce abrasion of the refractory material preferably used to form the metal-transmitting nozzle thereby reducing the amount of refractory contaminants usually to be found in metal powder atomized using a nonmetalic refractory metal-transmitting nozzle.

A further advantage results from the enhanced efficiency of operation resulting from conversation of the momentum of the atomizing fluid by reducing losses which otherwise would result from impingement of the atomizing fluid directly against the metal-transmitting nozzle. In utilizing the apparatus to make powder in accordance with the present invention, the flow rates of the atomizing fluid and the molten metal are maintained so as to ensure an effective coating of molten metal about the bottom portion of the metal-transmitting nozzle.

DESCRIPTION OF THE DRAWINGS

Further objects and advantages of this invention will be apparent from the following detailed description of a preferred embodiment and the accompanying drawings in which.

DESCRIPTION OF THE PREFERRED EMBODIMENT

Figure 1:
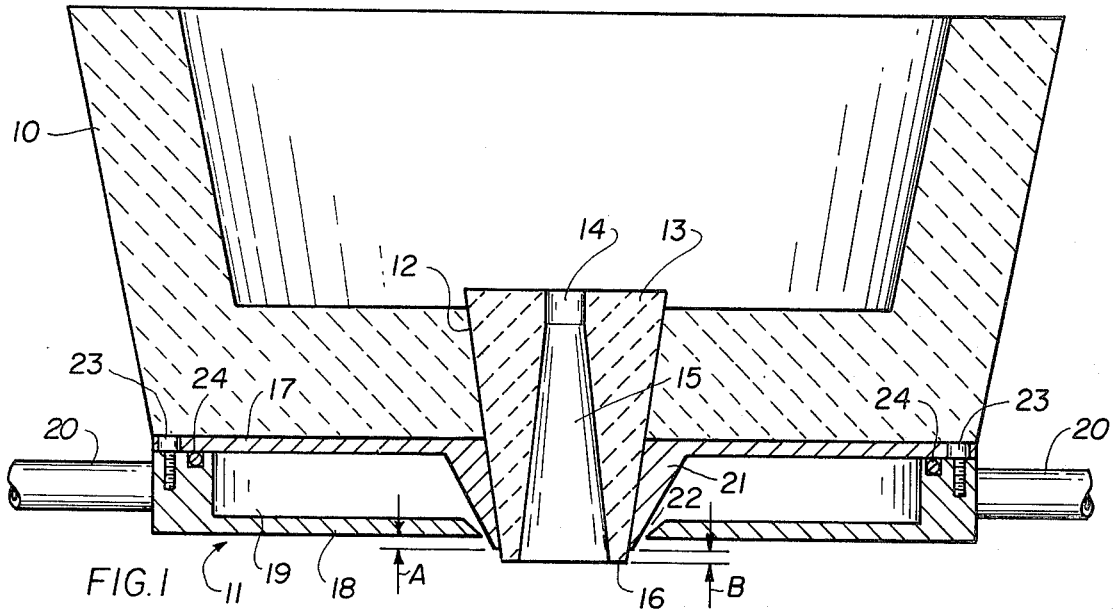
FIG. 1 is a somewhat schematic vertical sectional view of a nozzle assembly constructed in accordance with this invention.

Referring now to the drawings in detail, the preferred apparatus for making metal powder in accordance with the present invention comprises means forming a source of molten metal here shown as a tundish 10 seated on an atomizing fluid nozzle assembly 11. The tundish 10 is formed with a tapered central opening 12 in which a complementarily tapered metal-transmitting nozzle 13 is seated.

The nozzle 13 is preferably formed from a suitable refractory material such as alumina or zirconia and has at its upper end a relatively short cylindrical metering orifice 14 which opens into a downwardy divergent discharge passage 15, the bottom end of which preferably has a diameter substantially less than the outside diameter at the bottom of the nozzle thereby to define a flat annulus or land 16 at its discharge end disposed in a plane normal to the axis of the nozzle 13.

The atomizing fluid nozzle assembly 11 comprises top and bottom members 17 and 18, respectively, which together form an atomizing fluid plenum 19. Tangentially oriented supply pipes 20 connect the plenum 19 to a source of atomizing fluid under pressure (not shown). The atomizing fluid is preferably an inert gas such as argon, but other fluids can be used. The top member 17 has a tapered central portion 21 which projects downwardly through a central opening in the bottom member 18 to form therewith an annular atomizing fluid orifice 22 which preferably forms the smallest restriction that the atomizing fluid traverses in the entire system. As indicated in FIG. 1, top member central portion 21 extends beyond the bottom member 18 the distance "A", hereinafter referred to as "extension A". Central portion 21 is also formed with a tapered bore in which the bottom portion of metal-transmitting nozzle 13 snugly seats. As shown in FIG. 1, the lower end of the nozzle 13 projects beyond the central portion 21 by the amount "B".

As shown, the top and bottom members 17 and 18 are conveniently joined by means of an array of bolts 23, only two of which are shown, and are sealed together by means of an O-ring 24. Because it is not necessary to preheat the tundish before the atomization process is started, a wide variety of materials can be used for the O-ring. Buna-N type O-rings have given good results, but silicon rubber or polytetrafluorethylene can also be used.

The atomizing fluid nozzle assembly 11 can be made of any suitable material. Type 304 stainless steel has given good results, and higher heat resistant steels, e.g. Inconel 601, can be used.

Figure 2:
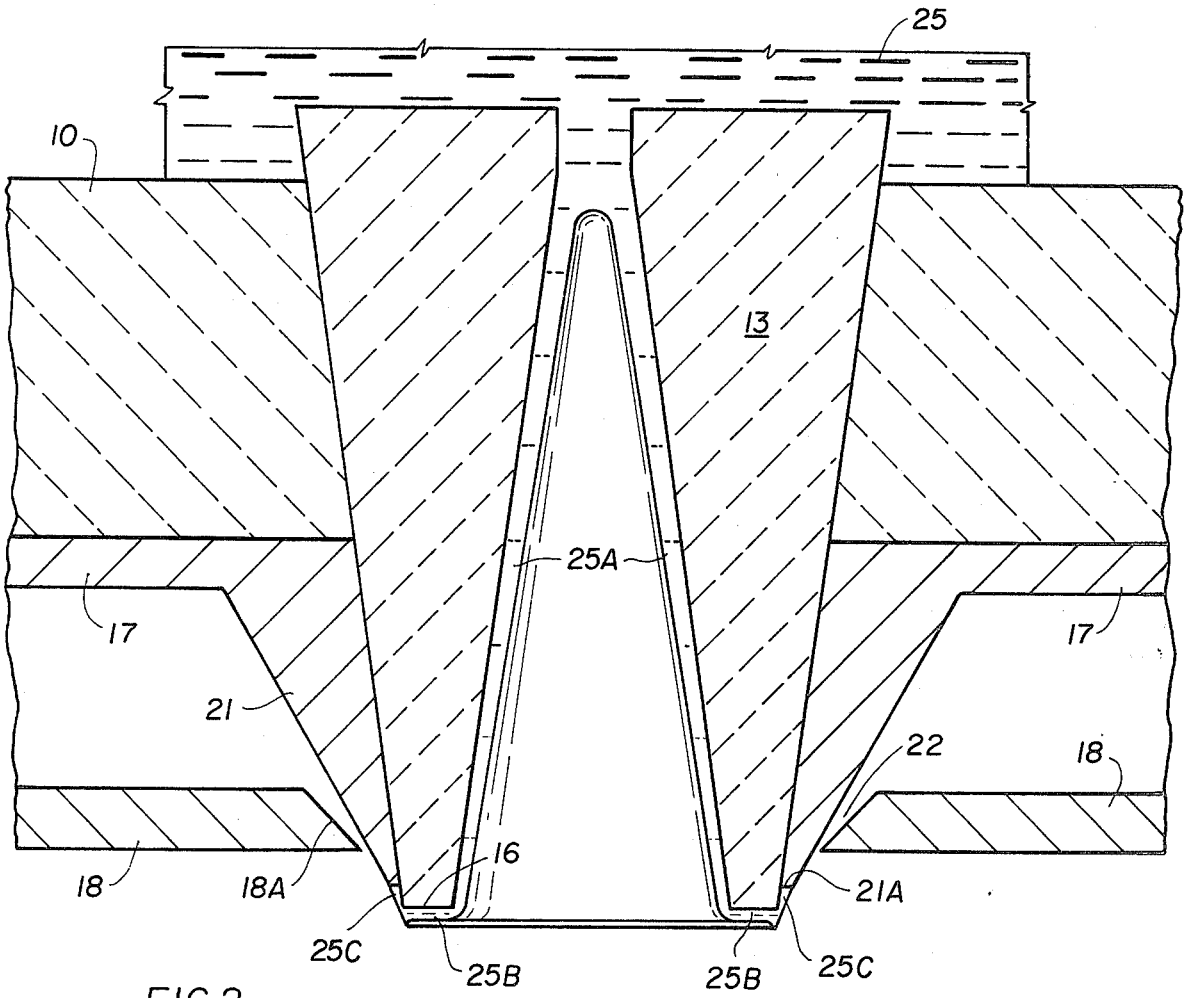
FIG. 2 is an enlarged vertical sectional view of the central portion of FIG. 1 showing the molten metal coating the tundish metal-transmitting nozzle.

As is most clearly shown in FIG. 2, the inner peripheral surface 18A forms an acute angle with the outer surface the bottom member 18 and is not parallel to the opposed surface of the top member central portion 21, those surfaces being disposed so that the maximum restriction formed by the surface 18A and the central portion 21 is at the exit end of the orifice 22. While the precise inclination of the surface 18A and the opposed surface of central portion 21 is by no means critical, an angle of about 10° between them has provided good results. In practice, the restriction for the orifice 22 of from about 0.003 to 0.006 in. (0.008 to 0.015 cm) will provide good results and about 0.004 in. (0.010 cm) is preferred. The size of the orifice 22 is readily adjusted by the use of shims on the radially outer side of the bolts 23 between the top and bottom members 17 and 18.

The location of the metering orifice 14 at the top end of the nozzle 13 which projects above the bottom of the tundish 10 into the molten metal reservoir insures sufficient heating of the nozzle 13 to prevent clogging and to maintain the desired fluidity of the molten metal passing through the restricted metering orifice 14.

In operation, as illustrated in FIG. 2, molten metal as it leaves the metering orifice 14, is drawn into a thin film 25A as it flows downward from the metering orifice 14 along the divergent walls of the discharge passage 15. Under the influence of forces believed primarily to be generated by the annular jet of atomizing fluid from the orifice 22, the metal 25A, on reaching the land 16, instead of falling away from the nozzle 13, is drawn outward to form a film 25B coating the land 16. At least part of the flow from the film 25B is drawn upward about the outer periphery of the bottom-end portion of the nozzle 13 to form molten film 25C extending to the annular surface 21A at the bottom of the top member central portion 21. The presence of the molten film 25C results from the relationship of the atomizing fluid nozzle assembly 11 and the metal-transmitting nozzle 13, each to the other, and the velocity of the atomizing fluid leaving the orifice 22. The shape of the film 25C-25B represents a substantial balance or equilibrium of the forces at the bottom of the nozzle 13 between the molten metal film and the atomizing fluid. Thus, the profile of the films 25B and 25C is termed a minimum energy surface and depends upon the velocity of the atomizing jet and its geometry on leaving the orifice 22. The foregoing features characteristic of the present apparatus and the manner in which atomization is carried out in accordance with the present invention result in minimization of the momentum lost by the atomizing fluid before it interacts with the sheet of molten metal leaving the outer periphery of the land 16.

The pressure of the atomizing fluid and its velocity on leaving the orifice 22 causes the outward flow of the metal to form a thin sheet for more effective atomization of the metal. The diameter of the metering orifice 14 in restricting the amount of molten metal which can flow through discharge passage 15, is also believed to affect the thickness of the sheet of molten metal which is drawn radially outward over the annular land 16. Increasing the diameter of metering orifice 14 permits a corresponding increase in the flow rate of the metal and is beleived to cause an increase in the thickness of the radially-outward flowing sheet of molten metal which in turn leads to an overall increase in particle size. At the other extreme, persistent clogging of the metal-transmitting nozzle 13 indicates that the metering orifice 14 has been reduced to too small a diameter. In practice, a metering orifice 14 having a length and diameter each about ¼ inch has given good results. Thus, the molten metal-transmitting nozzle 13 has a very short metering orifice 14 which is substantially within the molten metal reservoir of the tundish 10.

This ensures a substantially uniform radially-outward flow of molten metal sheet at the bottom of the nozzle 13. Metals having a solification temperature less than about 2500° F (about 1370° C) have been successfully atomized without introducing heat from any source other than the molten metal. Metals having a solidifaction temperature greater than about 2500° F (about 1370° C) have also been successfully atomized without adding a source of heat to the tundish by the simple expedient of increasing the amount of superheat in the metal before pouring it into the tundish.

It has been found that the combined extension A and B of the bottom portions of the top member central portion 21 and nozzle 13 below the exit end of orifice 22 which is in line with the bottom surface of bottom member 18 is critical to ensuring the formation of the desired metal film 25B and 25C and to preventing the atomizing fluid from backflowing through the nozzle discharge passage 15. As the extension A is reduced to about 0.070 in. (about 0.178 cm) the atomizing fluid has a tendency to backflow causing a bubbling or percolation in the molten metal which slows down the atomization process and could cause the nozzle 13 to become clogged. At such small values of the extension A in the neighborhood of about 0.070 in., the extension B of the nozzle 13 should be greater than about 0.063 in. (about 0.16 cm). Thus, the combined extension A + B should be greater than about 0.133 in. (about 0.338 cm). With the foregoing in mind, extension A may range from about 0:070 to 0.120 in. (about 0.178 to 0.305 cm), preferably about 0.115 in. (about 0.292 cm) and extension B from about 0.030 to 0.080 in. (about 0.076 to 0.203 cm), preferably about 0.060 to 0.070 in. (about 0.152 to 0.178 cm).

Land 16 at the bottom of the nozzle 13 preferably has substantial width which favors the formation of the radially outward flowing sheet of molten metal which is shattered by the atomizing fluid. Best results have been attained with the annular land 16 having an O.D. of about 1¼ in. (about 3.18 cm) and a width of about 0.125 to 0.190 in. (about 0.318 to 0.483 cm). A wider land can be used, but the maximum should not exceed that at which the metal can be drawn completely across it to be impinged by the annular atomizing jet from orifice 22.

It is to be noted that in carrying out the stream of the present invention, the pressure and flow rate of the atomizing fluid must be maintained high enough to ensure the formation of a hollow stream of molten metal in the nozzle passage 15 which flows radially outward over land 16 as a thin sheet. As was pointed out above, a coating of molten metal is maintained about the bottom of the nozzle 13 which extends up to the bottom 21A of central member 21. If the atomizing fluid pressure is too low, then excessive amounts of coarse particles are formed, and, when low enough, the molten metal stream will fall as a solid stream through the discharge passage 15. Economic considerations and the capability of the equipment determine the maximum atomizing fluid pressure to be used. Pressures of about 300 to 1000 psig (about 21.09 to 70.3 kg/sq cm) can be used with about 300 to 400 psig (about 21.09 to 28.12 kg/sq cm) being preferred. The same considerations govern control of the atomizing fluid flow, good results being obtainable over a range of about 400 to 1000 scfm (11.3 to 28.3 kl/min.).

The following examples demonstrate and provide a better understanding of the process and apparatus of the present invention:

EXAMPLE 1

A 180 lb. (82 kg) charge having the composition of Rene' 95 was superheated in a vacuum induction furnace about 450° F (about 232° C) above its solidus temperature and then tapped into a tundish 10 which, prior to pouring, was at room temperature. The tundish 10 was fitted with a metal-transmitting nozzle 13 having a metering orifice 14 about 0.25 in. (about 0.64 cm) in diameter which was also at room temperature at the start of the tap. The atomizing fluid nozzle assembly 11 used with the tundish 10 had an orifice 22 about 0.003 in. (about 0.008 cm) wide at its exit end. The extension A of central portion 21 was about 0.115 in. (about 0.292 cm) the extension B of the nozzle 13 was about 0.066 in. (about 0.168 cm). Argon under a pressure of about 365 lbs. psig (about 25.66 kg/sq cm) as measured in the plenum 19 and a flow rate of about 890 scfm (about 420 liters/sec) was used as the atomizing fluid. The molten metal was atomized in 3¾ minutes, with a resultant metal flow rate of about 48 lbs/min. (about 21.77 kg/min.) through the nozzle 13. The ratio of the gas flow rate to metal flow rate was 18.5 scf per pound of metal (1157.6 liters per kilogram of metal. The powder yield was screened and found to be made up of 83.3% −80 mesh, 78.3% −100 mesh and 57.7% −200 mesh (U.S. standard). These calculations were made using the starting charge weight of 180 lbs. as 100%.

EXAMPLE 2

A 181 lb. (82.1 kg) charge of Rene' 95 was prepared and atomized as described in Example 1, except that the annular orifice 22 measured 0.004 in. (0.010 cm). The metal flow rate through the nozzle 13 was about 47.22 lbs/min. (about 21.42 kg/min.), the gas pressure was about 400 psig (28.12 kg/sq cm) and the flow rate was about 1010 scfm (about 28.6 kl/min. ). These results indicate a 21.4 scf flow of argon per pound of metal (1335 liters per kilogram of metal). The atomized powder was screened and found to be 86.7% −80 mesh, 82.9% −100 mesh and 63.9% −200 mesh.

EXAMPLE 3

A 166 lb. (75.3 kg) charge of Rene' 95 was prepared and atomized as described in Example 1, except that the diameter of the metering orifice 14 of the metal-transmitting nozzle 13 was about 3/16 in. (about 0.476 cm), the atomizing fluid orifice 22 at its exit end was about 0.004 in. (0.010 cm), and extension B of nozzle 13 was about 0.068 in. (0.17 cm). The gas pressure was about 382 psig (26.9 kg/sq cm), the gas flow rate was about 900 scfm (25.5 kl/min.), and the metal flow rate through the nozzle 13 was about 29.3 lbs/min. (13.3 kg/min.). Thus, there was a 30.7 scf flow of argon per pound of metal (1916 liters per kilogram). The atomized powder was screened and found to be 90.7% −80 mesh, 88.4% −100 mesh, and 72.6% −200 mesh.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. Apparatus for atomizing a stream of molten metal, comprising means forming a reservoir for molten metal to be atomized, a metal-transmitting nozzle, means supporting said metal-transmitting nozzle with its intake end extending a predetermined distance into and communicating with said reservoir, said metal-transmitting nozzle having a short metering orifice formed at its intake end and having a length substantially equal to said predetermined distance with the ratio of its length to the diameter of said metering orifice being equal to about 1, said metal-transmitting nozzle having a discharge passage merging at its upper end with said metering orifice, said discharge passage being substantially longer than said metering orifice, said metal-transmitting nozzle at its discharge end terminating in an annular land extending in a plane normal to the axis of said discharge passage and at the end of the latter, the walls defining said discharge passage being downwardly divergent from said metering orifice to said land, means for forming a substantially hollow stream of molten metal at the discharge end of said metal-transmitting nozzle for drawing the molten metal substantially radially outward over said land with part of the metal coating the peripheral portion of said metal-transmitting nozzle from said annular land to the bottom of an annular wall portion and including means forming an annular atomizing fluid orifice surrounding the discharge end portion of said metal-transmitting nozzle with the exit opening of said orifice spaced above said land, and said last mentioned means forming said annular wall portion with the latter separating said atomizing fluid orifice and the discharge end portion of said metal-transmitting nozzle and extending below the exit opening of said atomizing fluid orifice toward said annular land.

2. Apparatus as set forth in claim 1 in which said last mentioned means forms an atomizing fluid chamber about said metal-transmitting nozzle communicating with said atomizing fluid orifice.

3. A method for atomizing a stream of molten metal in the apparatus of claim 2 in which molten metal is supplied to said reservoir, and an atomizing fluid is supplied to said atomizing fluid orifice at a pressure and flow rate such that molten metal in said discharge passage is formed into a substantially hollow stream and drawn substantially radially outward over said land to be impinged by said atomizing fluid with some of the molten metal coating the peripheral portion of said metal-transmitting nozzle from said annular land to the bottom of said annular wall portion.

4. A method for atomizing a stream of molten metal in the aparatus of claim 2 in which molten metal is supplied to said reservoir, an atomizing fluid is supplied to said atomizing fluid orifice at a pressure and flow rate such that molten metal in said discharge passage is formed into a substantially hollow stream and drawn substantially radially outward over said land to be impinged by said atomizing fluid with some of the molten metal coating the peripheral portion of said metal-transmitting nozzle from said annular land to the bottom of said annular wall portion, and heating said metal-transmitting nozzle substantially only with heat derived from said molten metal.

5. Apparatus as set forth in claim 2 in which said annular atomizing fluid orifice has a maximum restriction of from about 0.003 to 0.006 in., said annular wall portion extends below the exit opening of said atomizing fluid orifice by about 0.070 to 0.120 in., said annular wall portion is spaced from said annular land by about 0.030 to 0.080 in. and said land has an outer diameter of about 1¼ ins. and a width of about 0.125 to 0.190 in.

6. Apparatus as set forth in claim 5 in which said metering orifice is about ¼ in. long and has a diameter of about ¼ in., said annular atomizing fluid orifice restriction is about 0.004 in., said annular wall portion extends below the exit opening of said atomizing fluid orifice by about 0.115 in., and said annular wall portion is spaced from said annular land by about 0.060 to 0.070 in.

* * * * *

UNITED STATES PATENT OFFICE

CERTIFICATE OF CORRECTION

PATENT NO. : 3,988,084

DATED : October 26, 1976

INVENTOR(S) : David Esposito, Raymond A. Reiter and Gregory J. Del Corso

It is certified that error appears in the above-identified patent and that said Letters Patent are hereby corrected as shown below:

Front page, Item [75], for "Kehnorst" read -- Kenhorst --.

Col. 1, line 16, for "sream" read -- stream --;
line 19, after "powdered", insert -- metal --;
line 39, after "molten" insert -- metal --;
line 57, for "unformity" read -- uniformity --.

Col. 2, line 55, for "conversation" read -- conservation --.

Col. 3, line 23, for "downwardy" read -- downwardly --;
line 64, after "surface" insert -- of --.

Col. 4, line 58, for "beleived" read -- believed --.

Col. 5, line 3, for "solification" read -- solidification --;
line 6, for "solidifac-" read -- solidifica- --;
line 47, for "stream" read -- process --.

Col. 8, Pat. claim 3, line 2, for "2" read -- 1 --;
Pat. claim 4, line 2, for "aparatus" read -- apparatus --;
line 2, for "2" read -- 1 --;
Pat. claim 5, line 1, for "2" read -- 1 --.

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*